US007685907B2

(12) United States Patent
Nolting, Jr.

(10) Patent No.: US 7,685,907 B2
(45) Date of Patent: Mar. 30, 2010

(54) METHOD FOR MANUFACTURING EXTRUSION DIE TOOLS

(75) Inventor: Paul R. Nolting, Jr., Shelbyville, IN (US)

(73) Assignee: VIP Tooling, Inc., Shelbyville, IN (US)

( * ) Notice: Subject to any disclaimer, the term of this patent is extended or adjusted under 35 U.S.C. 154(b) by 951 days.

(21) Appl. No.: 10/918,596

(22) Filed: Aug. 13, 2004

(65) Prior Publication Data

US 2006/0032334 A1 Feb. 16, 2006

(51) Int. Cl.
*B21K 5/20* (2006.01)

(52) U.S. Cl. ..... 76/107.1

(58) Field of Classification Search ..... 76/107.1, 76/107.4, 107.6, 107.8; 72/467; 427/249, 427/248.1, 318, 372.2
See application file for complete search history.

(56) References Cited

U.S. PATENT DOCUMENTS

| | | | | |
|---|---|---|---|---|
| 3,807,212 | A * | 4/1974 | Lawson | 76/107.1 |
| 4,287,749 | A * | 9/1981 | Bachrach et al. | 76/107.1 |
| 4,574,459 | A | 3/1986 | Peters | |
| 4,585,619 | A * | 4/1986 | Westin | 419/28 |
| 5,061,163 | A | 10/1991 | Kennedy | |
| 5,093,151 | A | 3/1992 | van den Berg et al. | |
| 5,263,352 | A | 11/1993 | Yano | |
| 5,325,698 | A * | 7/1994 | Nagpal et al. | 72/358 |
| 5,342,189 | A | 8/1994 | Inamura et al. | |
| 5,351,398 | A * | 10/1994 | Haxell | 29/890.142 |
| 5,571,235 | A | 11/1996 | Yano | |
| 5,572,894 | A | 11/1996 | Yano | |
| 5,832,768 | A | 11/1998 | Yano | |
| 5,974,850 | A | 11/1999 | Huang et al. | |
| 6,134,936 | A | 10/2000 | Cheung | |
| 6,176,153 | B1 | 1/2001 | Maier | |
| 6,351,979 | B1 | 3/2002 | Inamura et al. | |
| 6,370,934 | B1 | 4/2002 | Maier | |
| 6,773,662 | B2 * | 8/2004 | Fisher et al. | 148/334 |
| 2007/0000117 | A1 * | 1/2007 | Brandstatter et al. | 29/527.2 |

FOREIGN PATENT DOCUMENTS

| | | | |
|---|---|---|---|
| DE | 3221388 | A1 | 12/1983 |
| DE | 19810015 | A1 | 3/1999 |
| WO | WO 03/068503 | A1 | 8/2003 |

OTHER PUBLICATIONS

European Patent Office, Supplementary European Search Report, Mar. 25, 2008.

* cited by examiner

*Primary Examiner*—Jason Daniel Prone
(74) *Attorney, Agent, or Firm*—Ice Miller LLP; Alexander D. Forman; Natalie J. Dean

(57) ABSTRACT

The subject invention relates to a new method for manufacturing extrusion die tools that eliminates the step of hardening the steel after cutting the steel to form the desired extrusion die tool design. The new method involves the steps of cutting and finishing steel to form the desired extrusion die tool design, coating the die tool, or parts thereof, and hardening the coated die tool. The new method for manufacturing extrusion die tools reduces the time and the cost involved in their manufacture.

24 Claims, 4 Drawing Sheets

METHOD FOR MANUFACTURING EXTRUSION DIE TOOLS

BACKGROUND OF THE INVENTION

Extrusion fabrication is a known process that involves forcing material, generally aluminum or aluminum alloy under a combination of heat and pressure, so as to be flowable (normally referred to as a "billet"), through an extrusion die tool to form a product having a cross section that matches the extrusion profile of the die tool. Many manufacturing processes involve extrusion fabrication. For example, extrusion fabrication is widely used in the manufacture of flat, multi-cavity aluminum tubes, which are used for small heat exchanger components in air-conditioners, condensers, and radiators.

U.S. Pat. No. 6,176,153 B1 to Maier ("Maier") discloses a current method known in the art for manufacturing extrusion die tools, and is incorporated herein by reference. FIG. 1 shows a flow diagram of the Maier method. As shown in FIG. 1, the method begins with cutting steel in Step 10 to form the desired extrusion die tool design. In Step 10, the extrusion die tool is machine cut in a series of sub-steps from annealed (i.e., non-hardened), hot-working steel on machinery well-known in the art, such as a lathe and/or a mill, into a semi-finished state. The semi-finished state refers to the extrusion die tool being cut into the general, desired shape but not being cut to its final dimensions. Thus, a certain amount of stock metal remains on the extrusion die tool after this cutting step and will have to be removed later on in the manufacturing process.

After the extrusion die tool is cut into its semi-finished state, the die tool is hardened for the first time in Step 20 using known hardening processes. After the extrusion die tool is hardened in Step 20, the die tool is finished to its final dimensions in Step 30. In Step 30, the stock metal left on the extrusion die tool from Step 10 is ground and cut off until the die tool is shaped to the desired final dimensions (i.e., the "finished state"). As a result of the hardening process of Step 20, the extrusion die tool cannot be easily cut on a lathe or a mill in Step 30. Rather, the extrusion die tool is finished in Step 30 by a process utilizing surface grinders, polishing machines, and electric discharge machines ("EDMs"). The Maier method involves the use of both a conventional EDM and a wire EDM to make all the necessary cuts to produce a finished die tool. It will be appreciated that due to the amount of cuts performed by a conventional EDM, the use of the conventional EDM is very time consuming and costly because it utilizes an electrode, such as a copper or graphite electrode, that must be replaced for each cycle of cuts in this process.

After the extrusion die tool is finished, the extrusion die tool is coated in Step 40 by the chemical vapor deposition ("CVD") process described in Maier. As described in Maier, the extrusion die tool is coated at pre-determined locations with a wear resistant carbidic, nitridic, boridic, and/or oxidic-coating material. After the finished extrusion die tool is coated at the desired location(s), the die tool is rehardened in Step 50 by known hardening processes. On the Rockwell C-scale of hardness ("Rc"), the die tool is hardened to a hardness of about 46-50 Rc.

Each of the aforementioned steps is time consuming and expensive. The two hardening steps alone add two to four days worth of time onto the manufacturing process for extrusion die tools. Further, cutting an extrusion die tool into its semi-finished state and then finishing the die tool into its finished state require a large number of processing steps. As will be appreciated by one skilled in the art, the finishing step is time-consuming due to the fact the steel has already been hardened which increases the difficulty of making the finishing cuts. Any reduction in the time required to manufacture extrusion die tools can provide an extreme benefit to manufacturers of these tools. Thus, what is needed is a method that reduces the time and cost involved in manufacturing extrusion die tools.

BRIEF SUMMARY OF THE INVENTION

The subject invention relates to a new method for manufacturing extrusion die tools. An exemplary embodiment of the method for manufacturing extrusion die tools involves the steps of cutting and finishing annealed steel to form a finished state of an extrusion die tool, coating at least one portion of the finished extrusion die tool with a wear resistant coating, and hardening the entire extrusion die tool. The coating step can use any number of coating processes that properly coats the die tool at high temperatures, including, but not limited to, a CVD coating process. The hardening of the die and any coated portions is conducted using any number of hardening processes known in the art.

This method can be used to prepare extrusion die tool inserts for extrusion die tools, such as mandrels and sizing plates, for both closed and open extrusion die tool designs using either high-speed or hot-working steels. These inserts can then be assembled with an annular base of an open die tool or a female and male body of a closed die tool. An exemplary high-speed steel that can be used in this method to produce these inserts has a chemical composition that comprises one or more of the following: Carbon; Manganese; Silicon; Chromium; Vanadium; Tungsten; Molybdenum; Cobalt; Sulfur; and Iron. An exemplary hot-working steel that can be used in this method to produce the inserts and/or the annular base or female and male bodies of an open and closed extrusion die tool, respectively, has a chemical composition that comprises one or more of the following: Carbon; Manganese; Silicon; Chromium; Molybdenum; Vanadium; and Iron. In this embodiment, the die tool and any coated portions thereof are hardened to about 46-50 Rc for hot-working steel and to about −53-56 Rc for high-speed steel.

DETAILED DESCRIPTION OF THE INVENTION

The subject invention relates to a new method for manufacturing extrusion die tools that reduces the time and cost involved in their manufacture. FIG. 2 shows a flow diagram of an exemplary embodiment of the subject invention. The differences between this embodiment and the method known in the art can be best seen by comparing FIGS. 1 and 2. As shown in FIG. 2, this exemplary method of manufacturing an extrusion die tool has a cutting and finishing Step 61 that both cuts and finishes annealed steel into the finished state of the desired extrusion die tool design. Thus, unlike the Maier method shown in FIG. 1, this exemplary method does not cut annealed steel into a semi-finished state, harden the semi-finished die tool, and then finish the hardened die tool into its finished state. Rather, as shown in Step 61 in FIG. 2, this exemplary method cuts and finishes annealed steel into the finished state (i.e., the die is cut to its final dimensions) of the desired extrusion die tool. Thus, this exemplary method eliminates the first hardening Step 20 of the Maier method.

Further, by virtue of annealed steel not undergoing a first hardening step, a lathe and/or a mill, instead of a conventional EDM, can now be employed in Step 61 to machine cut the extrusion die tool to its final dimensions. While a conventional EDM may still be required to make detailed cuts (i.e., cutting small grooves or channels on the die tool), the use of a conventional EDM is substantially reduced in this process. Thus, the electrode of the conventional EDM does not have to be replaced as frequently and the time devoted to the preparation of the conventional EDM is substantially reduced, if not eliminated altogether (in the event no detailed cuts are needed). As a result, the finishing of such an extrusion die tool can be completed within minutes, instead of the several-hours timeframe associated with the finishing of a die tool using a combination of conventional and wire EDMs.

Figure 1:
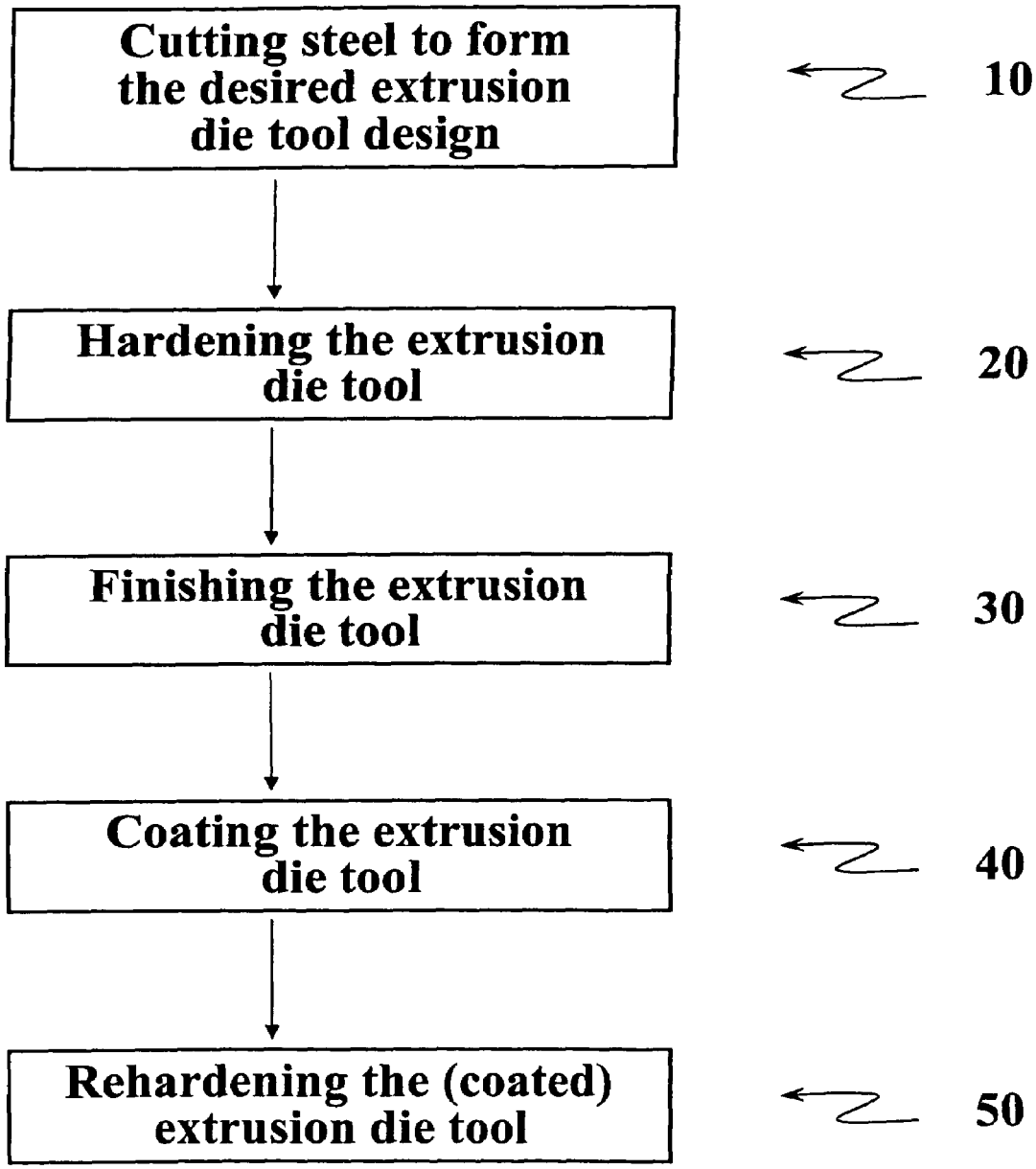
FIG. 1 (Prior Art)
FIG. 1 shows a flow diagram of the method known in the prior art for manufacturing extrusion die tools.
Figure 2:
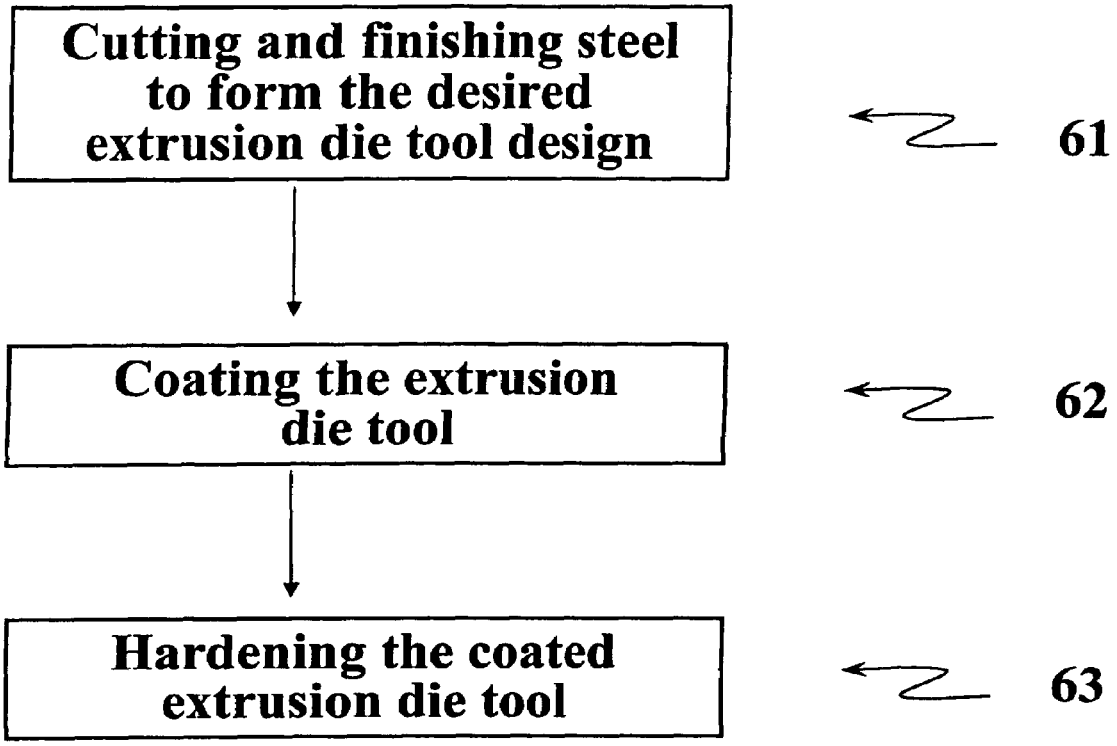
FIG. 2 shows a flow diagram of an exemplary embodiment of the method of the subject invention for manufacturing extrusion die tools.

Moreover, by eliminating the hardening Step 20 of FIG. 1, the exemplary method of FIG. 2 reduces the time needed for and the inherent production costs associated with the manufacturing of extrusion die tools, regardless of whether a wire EDM or a combination of conventional and wire EDMs is used to finish an extrusion die tool. Eliminating the first hardening Step 20 of FIG. 1, does not seem to have any adverse effect on the quality of the resulting extrusion die tool, and has been found to increase the life of the die tool so that it does not wear out as quickly as die tools produced from the Maier method.

Referring back to FIG. 2, instead of wasting time waiting for the steel to harden, the extrusion die tool can now be immediately coated in Step 62 and then hardened in Step 63 to complete the die tool. As already discussed above, the exemplary method also has the added benefit of allowing steel to be processed in its non-hardened, annealed state, which lends itself to easier cutting and finishing into the desired extrusion die tool design. Thus, instead of cutting annealed steel into a semi-finished extrusion die tool, hardening the semi-finished die tool, and then finishing the hardened die tool, the exemplary method shown in FIG. 2 cuts and finishes annealed steel into a finished die tool in Step 61. By cutting and finishing annealed steel, the exemplary method eliminates the need to use certain types of equipment, such as various types of mills and grinders, and reduces, if not eliminates, the need to use conventional EDMs, to finish a hardened semi-finished extrusion die tool into a finished die tool. The elimination of such equipment, in conjunction with cutting and finishing a die tool from annealed steel, reduces machine time by as much as fifty percent, which in turn, leads to a further reduction in the inherent cost of manufacturing extrusion die tools. Steel in the annealed state is more susceptible to surface marring and thus, greater care must be exercised in its handling. For example, whereas hardened steel permits the use of a coarse-grit polishing compound, it is advisable with annealed steel to use a finer-grit compound at a lower pressure to polish the extrusion die tool in order to prevent surface marring in Step 61.

Figure 3:
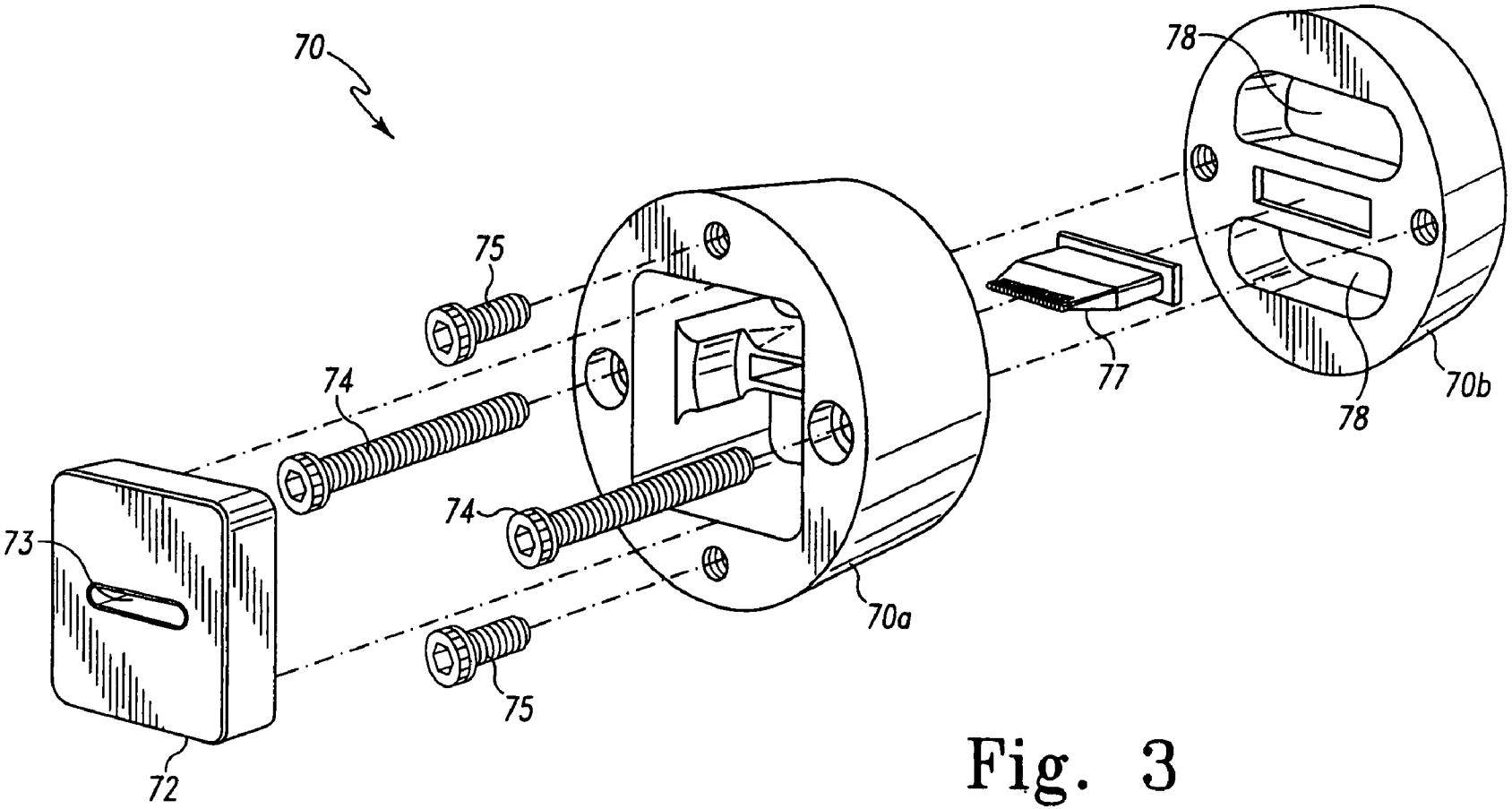
FIG. 3 shows an exploded view of a "closed" extrusion die tool that can be manufactured by the method of the subject invention.

A variety of extrusion die tools can be manufactured from annealed steel using this exemplary method. For example, FIG. 3 shows an exploded view of a "closed" extrusion die tool 70 used to manufacture flat aluminum tubes for small heat exchanger components in air-conditioners that can be manufactured using this exemplary embodiment. As shown in FIG. 3, the "closed" extrusion die tool comprises a two-piece die tool 70 with a male body 70*b* and a female body 70*a*. Male body 70*b* has a comb-like mandrel insert 77 and has ports 78 that are enclosed by the exterior of the male body 70*b*. The enclosed ports 78 represent the feature that distinguishes die tool 70 as a "closed" extrusion die tool. Female body 70*a* has a sizing plate insert 72 with an extrusion slot 73. Screws 74 fasten together male body 70*b* and female body 70*a* of die tool 70. Screws 75 can be used to hold in place an optional spacer plate (not shown), which serves to adjust the height of sizing plate insert 72.

Figure 4:
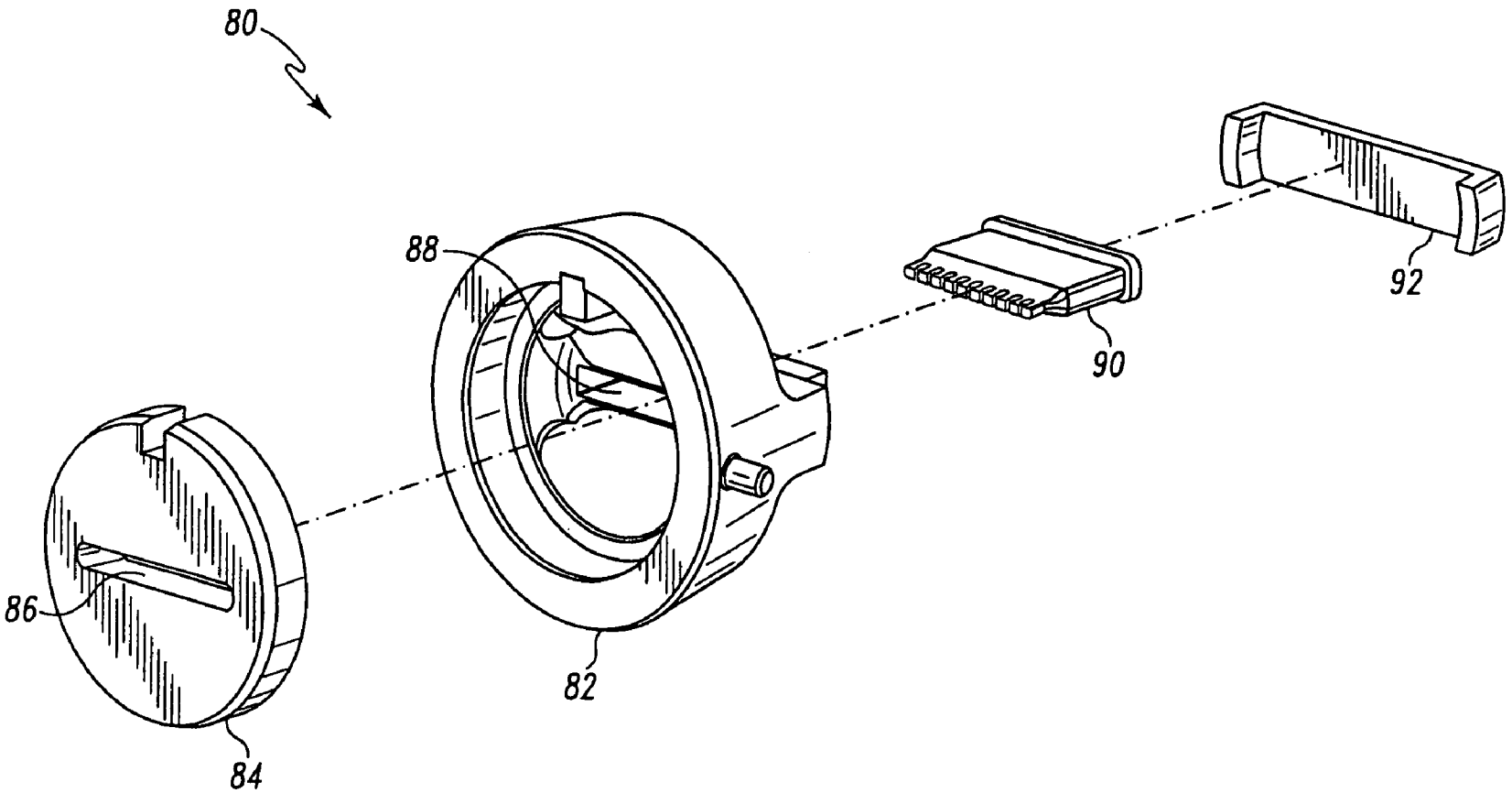
FIG. 4 shows an exploded view of an "open" extrusion die tool that can be manufactured by the method of the subject invention.

FIG. 4 shows an exploded view of an "open" extrusion die tool 80 also used to manufacture flat aluminum tubes for heat exchanger components in air-conditioners that can be manufactured using this exemplary method. As shown in FIG. 4, the "open" extrusion die tool 80 has an annular base 82 that holds a sizing plate 84 with an extrusion slot 86. Further, die tool 80 has an open backside with a receiving slot 88 that retains a comb-like mandrel 90. A splitter plate 92 is used to cover receiving slot 88 and the backside of mandrel 90. The lack of ports enclosed by an exterior surface distinguishes die tool 80 as an "open" extrusion die tool. While the two aforementioned extrusion die tools are representative of die tools that can be manufactured from this method, any number of extrusion die tools can be manufactured using this exemplary embodiment of the method of the subject invention. For example, a closed and open die design with integral sizing plates and mandrels can also be manufactured by this exemplary method.

Either of the die tools 70 and 80 can be manufactured utilizing the exemplary method shown in FIG. 2. Referring back to FIG. 2, a hot-working steel can be used in Step 61 to create the male body 70*b* and female body 70*a* of closed die tool 70 and annular base 82 of open die tool 80. Hot-working steels provide a combination of high-temperature strength, wear resistance, and toughness that is ideal for extrusion die tools. An example of hot-working steel employed in this exemplary embodiment to manufacture the bodies and/or the annular base of an closed and open extrusion die tool is NU-DIE® V (AISI H13) hot-working steel, which has a typical chemical composition by weight percentage of the total amount of the composition of: 0.40% Carbon; 0.35% Manganese; 1.00% Silicon; 5.20% Chromium; 1.30% Molybdenum; and 0.95% Vanadium; with Iron comprising the remaining composition (approximately 90.80%). While an exemplary type of hot-working steel is provided, any type of hot-working steel, which has typical chemical composition ranges by weight percentage of the total amount of the composition of: 0.32-0.55% Carbon; 0.3-1.5% Manganese; 0.20-1.5% Silicon; 1.1-5.50% Chromium; 0.5-1.50% Molybdenum; and 0.13-1.2% Vanadium, with Iron comprising the remaining composition, can be used in this method, as can any other steel with like properties.

Still referring to FIG. 2, a high-speed steel can be used to manufacture mandrel inserts 77 and 90 and sizing plates 72 and 84 of closed die tool 70 and open die tool 80, respectively. High-speed steels are high alloy, W—Mo—V—Co bearing steels that are normally used in high-speed cutting tools that can withstand the high extreme heat generated at the cutting edge. An example of a high-speed steel that can be used to manufacture the mandrel and sizing plate inserts is CPM REX 76® (AISI M48) high-speed steel, which has a typical chemical composition by weight-percentage of the total amount of the composition of: 1.5% Carbon; 0.30% Manganese; 0.30% Silicon; 3.75% Chromium; 3.10% Vanadium; 9.75% Tungsten; 5.25% Molybdenum; 8.50% Cobalt; and 0.06% Sulfur; with Iron comprising the remaining composition (approximately 67.49%). While an exemplary embodiment of high-speed steel is provided, any type of high-speed steel, which has typical chemical composition ranges by weight-percentage of the total amount of the composition of: 0.55-2.3% Carbon; 0.3-0.4% Manganese; 0.3-0.4% Silicon; 3.75-4.50% Chromium; 1.0-6.5% Vanadium; 1.5-18.0% Tungsten; 0-9.5% Molybdenum; 0-12.0% Cobalt; and trace amounts of Sulfur, with Iron comprising the remaining composition, can be used in this method. Further, the mandrel and sizing plate inserts could also be manufactured from hot-working steel or any other steel that has similar properties to high-speed and hot-working steels.

After Step 61 is completed, the desired parts of the extrusion die tool are coated with a wear resistant coating in Step 62 using known coating processes at high temperatures that, by virtue of the high temperatures (i.e., temperatures that fall in the range of approximately 1000-1300° F.) at which they are conducted, serve to both coat and partially harden the steel. For example, the CVD coating process disclosed in Maier can be used to coat the desired parts of the extrusion die tool. The CVD coating is prepared from a coating material selected from the group containing titanium carbide, titanium nitride, titanium boride, vanadium carbide, chromium carbide, aluminum oxide, silicon nitride, and combinations thereof; and the coating is applied in a CVD process, preferably at temperatures in the range of 1200° F.-1300° F., to the surface of the desired portions of the extrusion die tool. Thermally-activated CVD is known in the art for the production of single crystals, the impregnation of fiber structures with carbon or ceramics, and generally for the deposition of thin layers, either by growth onto a surface or by the diffusion of borides, carbides, nitrides, and/or oxides. By virtue of the aforementioned coating and thermally-activated CVD coating step, a wear-resistant layer is provided for the coated portions of the extrusion die tool, which uniformly, regularly, and adhesively covers the coated portions. While the entire extrusion die tool itself can be coated, it is more cost-effective to coat only certain portions of the die tool. For example, only the mandrel inserts 77 and 90 of the closed and open die tools 70 and 80, respectively, are coated. While this exemplary method uses a CVD coating process, any number of coating processes can be used.

Following the coating step, the coated and uncoated portions of the extrusion die tool are hardened using known hardening processes in Step 63. For example, one hardening process known in the art first involves heating the coated and uncoated portions of the extrusion die tool to a temperature of at least 100° F. above the critical or transformation point of its component steel, a point also known as its decalescence point, so that the steel becomes entirely austenitic in structure (i.e., a solid solution of carbon in iron). The coated and uncoated portions of the extrusion die tool steel are then quenched. The quenching process suddenly cools the coated and uncoated portions of the die tool at a rate that depends on the carbon content, the amount of alloying elements present, and the size of the austenite, to produce fully-hardened steel. Following quenching, the resulting extrusion die tool is tempered in order to reduce the brittleness in its hardened steel and to remove the internal strains caused by the sudden cooling associated with quenching. The tempering process consists of heating the quenched, coated and uncoated portions of the extrusion die tool by various means, such as immersion in an oil, lead, or salt bath, to a certain temperature, which may range from 1000-1200° F. for hot-working or high-speed steel, and then slowly cooling the die tool. In this embodiment, the portions of the die tool cut and finished from hot working steel is hardened to about 46 to 50 Rc, and the portions cut and finished from high-speed steel is hardened to about 53 to 56 Rc. This is just one hardening process known in the art that can be used in this method. Any other type of hardening process can be utilized in association with this method.

As already explained, this exemplary method of the subject invention reduces the number of steps, the amount of time, and the corresponding cost of manufacturing extrusion die tools. This can be further seen by comparing and contrasting how one would manufacture a mandrel insert using the Maier method and the exemplary method described above. In particular, and in reference to FIG. 1, the Maier method requires: (a) six discrete cutting operations in Step 10, which include one lathe-cutting operation and five mill-cutting operations; (b) hardening in Step 20; (c) eight discrete finishing operations in Step 30, which include four surface grinding operations, one conventional and two wire EDM operations, and a polishing operation; (d) coating in Step 40; and (e) rehardening the (now coated) mandrel in Step 50, for a total of seventeen process steps. In contrast, and in reference to FIG. 2, the exemplary method of the subject invention utilizes: (a) ten discrete cutting and finishing operations in Step 61, which include one lathe-cutting operation, two surface grinding operations, three mill-cutting operations, two wire EDM operations; a chamfering operation, and a polishing operation; (b) coating in Step 62, and (c) hardening the coated extrusion die tool in Step 63, for a total of twelve process steps, i.e., a five-step reduction relative to the Maier method. Further, as already explained, the elimination of a hardening step and the reduced use or elimination of the conventional EDM reduces machining time by approximately fifty percent.

This exemplary method of the subject invention reduces the number of steps involved in manufacturing extrusion die tools and, accordingly, the time and cost involved in manufacturing these tools. This reduction in time and cost arises primarily from the elimination of a first hardening step in the Maier method of manufacturing extrusion die tools. The elimination of the first hardening step not only saves the amount of time that it would take to harden the semi-finished die tool, but also decreases the use of certain types of equipment in the manufacturing process, such as mills and various types of surface grinders, and may eliminate entirely the use of a conventional EDM from the manufacturing process. Elimination of a conventional EDM eliminates the need for and the concomitant preparation time and cost associated with the electrode required in a conventional EDM. Further, the exclusive use of a wire EDM in the method of the subject invention, in lieu of the combination of conventional and wire EDMs, permits final finishing to be completed within minutes, instead of several-hours. Thus, this exemplary method substantially reduces the amount of time needed to manufacture an extrusion die tool.

While an exemplary method of the subject invention has been described in considerable detail with reference to a particular embodiment thereof and particular extrusion die tools resulting therefrom, such are offered by way of non-limiting examples of the invention, as other versions of the invention and other products resulting from the invention are possible. It is anticipated that a variety of modifications of and changes to the subject invention will be apparent to those having ordinary skill in the art and that such modifications and changes are intended to be encompassed within the spirit and scope of the pending claims.

I claim:

1. A method for manufacturing an extrusion die tool, the method comprising the steps of:

cutting and finishing steel to form a finished state of the extrusion die tool, wherein the cutting and finishing steps occur without hardening the extrusion die tool in between the cutting and finishing steps;

coating at least one portion of the extrusion die tool with a wear resistant coating at a high temperature; and hardening the extrusion die tool and the at least one coated portion.

2. The method of claim 1, wherein the at least one portion coated in the coating step comprises a mandrel.

3. The method of claim 1, wherein the extrusion die tool is an open extrusion die tool and the cutting and finishing steps form the finishing state of the open extrusion die tool comprising a mandrel insert, a sizing plate insert, and an annular base.

4. The method of claim 3, wherein the at least one portion of the die tool coated in the coated step is the mandrel insert by way of a CVD coating process.

5. The method of claim 4, further comprising the step of inserting the mandrel insert and sizing plate into the annular base.

6. The method of claim 3, wherein the cutting and finishing steps comprise cutting and finishing an annealed high-speed steel to form the mandrel insert and the sizing plate insert and hot-working steel to form the annular base.

7. The method of claim 6, wherein a chemical composition of the annealed high-speed steel comprises one or more of: Carbon, Manganese, Silicon, Chromium, Vanadium, Tungsten, Molybdenum, Cobalt, Sulfur, and Iron.

8. The method of claim 6, wherein a chemical composition of the hot-working steel comprises one or more of: Carbon, Manganese, Silicon, Chromium, Molybdenum, Vanadium and Iron.

9. The method of claim 1, wherein the cutting and finishing steps comprise cutting and finishing an annealed high-speed steel to form a mandrel insert and a sizing insert.

10. The method of claim 9, wherein a chemical composition of the annealed high-speed steel comprises one or more of: Carbon, Manganese, Silicon, Chromium, Vanadium, Tungsten, Molybdenum, Cobalt, Sulfur, and Iron.

11. The method of claim 9, wherein the at least one portion of the die tool coated in the coating step is the mandrel insert by way of a CVD coating process.

12. The method of claim 1, wherein the coating step comprises coating the at least one portion of the extrusion die tool at a temperature between about 1200° F.-1300° F.

13. The method of claim 12, wherein the coating step comprises a CVD coating process.

14. The method of claim 1, wherein the extrusion die tool is closed extrusion die tool and the cutting and finishing steps form the finishing state of the closed extrusion die tool comprising a mandrel insert, sizing plate insert, a male body, and a female body.

15. The method of 14, wherein the at least one portion of the die tool coated in the coating step is the mandrel insert by way of a CVD coating process.

16. The method of claim 15, further comprising the step of inserting the mandrel into the female body and the sizing plate into the male body.

17. The method of claim 16, further comprising the step of connecting the male body to the female body.

18. The method of claim 14 wherein the cutting and finishing steps comprise cutting and finishing an annealed high-speed steel to form the mandrel insert and the sizing plate insert and cutting and finishing hot-working steel to form the male and female bodies of the closed extrusion die tool.

19. The method of claim 18, wherein a chemical composition of the annealed high-speed steel comprises one or more of: Carbon, Manganese, Silicon, Chromium, Vanadium, Tungsten, Molybdenum, Cobalt, Sulfur and Iron.

20. The method of claim 19, wherein a chemical composition of the annealed hot-working steel comprises one or more of: Carbon, Manganese, Silicon, Chromium, Molybdenum, Vanadium, and Iron.

21. A method for manufacturing an extrusion die tool, the method comprising the steps of:

cutting and finishing steel to form a finished state of the extrusion die tool having a mandrel insert, a sizing plate insert and an annular base, wherein the cutting and finishing steps occur without hardening the extrusion die tool in between the cutting and finishing steps;

coating the mandrel insert of the extrusion die tool with a wear resistant coating at a high temperature; and hardening the extrusion die tool and the mandrel insert.

22. The method of claim 21, wherein the cutting and finishing steps comprise cutting and finishing an annealed high-speed steel to form the mandrel insert and the sizing plate insert and hot-working steel to form the annular base.

23. The method of claim 22, wherein a chemical composition of the annealed high-speed steel comprises one or more of: Carbon, Manganese, Silicon, Chromium, Vanadium, Tungsten, Molybdenum, Cobalt, Sulfur, and Iron.

24. The method of claim 22, wherein a chemical composition of the hot-working steel comprises one or more of: Carbon, Manganese, Silicon, Chromium, Molybdenum, Vanadium and Iron.

* * * * *